United States Patent [19]

Tsai et al.

[11] 4,405,260

[45] Sep. 20, 1983

[54] METHOD OF CONSTRUCTING UNDERPASS ACROSS RAILWAY AND HIGHWAY WITHOUT AFFECTING NORMAL TRAFFIC THEREOF

[76] Inventors: Tepin Tsai, 4th Fl., 114 Fu-Hsing South Rd., Sec. 2; Teh-Chung Tsai, 35 Chung-Hsiao East Rd., Sec. 4, both of Taipei, Taiwan

[21] Appl. No.: 275,771

[22] Filed: Jun. 22, 1981

[51] Int. Cl.[3] ..... E21D 9/00

[52] U.S. Cl. ..... 405/184; 405/138

[58] Field of Search ..... 405/184, 132, 139, 141; 175/53, 62

[56] References Cited

U.S. PATENT DOCUMENTS

| | | | |
|---|---|---|---|
| 440,576 | 11/1890 | Radcliffe | 405/138 |
| 960,940 | 6/1910 | Jackson | 405/139 |
| 2,074,003 | 3/1937 | Templeton et al. | 405/184 X |
| 2,325,565 | 7/1943 | Williams | 405/184 |
| 3,968,655 | 7/1976 | McGlothlin | 405/139 |
| 4,009,579 | 3/1977 | Patzner | 405/138 |
| 4,166,509 | 9/1979 | Ueno et al. | 405/139 X |

FOREIGN PATENT DOCUMENTS

| | | | |
|---|---|---|---|
| 2745956 | 4/1979 | Fed. Rep. of Germany | 405/184 |

*Primary Examiner*—Dennis L. Taylor

*Attorney, Agent, or Firm*—Browdy and Neimark

[57] ABSTRACT

A method of constructing underpass across railway and highway includes the steps of excavating a traction ditch on one side of the road foundation and a launching ditch on the other; building a traction wall with traction holes therein against the road foundation in the traction ditch; and sequentially tracting a precast box culvert one after another through perforating, anchoring and jack driving according to the construction line until a predetermined configuration is completed thereat. Subsequently, build pier foundations, supports, and a bridging beam; arrange shell pipes; place PC steel reinforcements; and, after a certain curing period, perform prestress operations in the precast box culverts of the structure and grout cement mortar therein. Finally, excavate the earth volume under the structure and finish the road surface of the underpass for opening to traffic.

6 Claims, 6 Drawing Figures

METHOD OF CONSTRUCTING UNDERPASS ACROSS RAILWAY AND HIGHWAY WITHOUT AFFECTING NORMAL TRAFFIC THEREOF

BACKGROUND OF THE INVENTION

1. Field of the Invvention

This invention relates to a method for constructing underpass, particularly the underpass across railway and highway, without affecting the normal trafffic thereof.

2. Description of the Prior Art

Conventionally, methods adopted for constructing underpass across railway and highway include the "tunnel digging" method and the "thrust propelling" method.

The "tunnel digging" method is a primitive process commonly adopted in the construction of underpasses. Although it requires less power equipment, yet much working time and manpower are needed in the process of construction because a good deal of protective works such as steel pipe roof and support ground have to be built before starting the digging operation. In addition, excavation of the earth work and building of the buttress support and concrete top frame have to be done alternatively. Moreover, in the process of excavation, security problem is a main concern as this method is subject to the vibration caused by the traffic on the road surface, often resulting in the sagging of the road foundation.

In the "thrust propelling" method, protective works such as steel pipe roof and piled wall have to be arranged, and a strong reaction wall has to be built for thrust propelling operation. Besides, heavy-duty power facilities such as pushing and pulling jacks have to be used for thrusting the precast box culvert into the road foundation in conjunction with the construction line. Such method also suffers because it requires more manpower, more working time, and more costs. Moreover, if any error occurs in the process of thrusting, it is very difficult to make correction therefrom.

SUMMARY OF THE INVENTION

This invention provides a method of constructing underpass across railway and highway through traction operation including the steps of excavating two ditches on both sides of the road foundation; building a traction wall against the road foundation; anchoring a steel cable between the traction wall and the precast box culvert through the road foundation; tracting the arranged box culvert into the road foundation one after another according to the construction line; applying prestress operation; concreting; excavating the earth under the structure of the box culverts; and finishing the road surface of the underpass.

The primary object of this invention is to provide a method for constructing underpass without being subject to the traffic vibration on the road surface so that the construction work can be conducted safely, and working time is greatly reduced.

Another object of this invention is to provide a method for constructing underpass without erecting protective works such as steel pipe roof or steel sheet piled wall, which are usually required by the "tunnel digging" method and the "thrust propelling" method, so that manpower and working costs can be considerably reduced.

Other objects and advantage of this invention will become apparent from the following detailed description, which, taken in conjunction with annexed drawings, discloses a preferred form of the present invention.

DETAILED DESCRIPTION OF THE INVENTION

Figure 1:
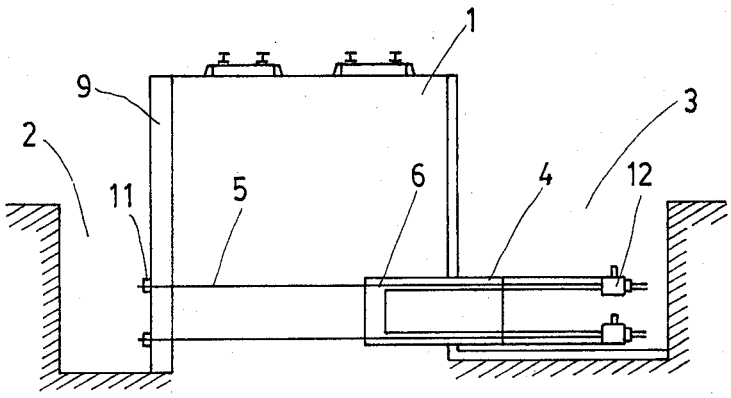
FIG. 1 is a schematic illustration presenting a method of box-culvert traction according to the invention.
Figure 2:
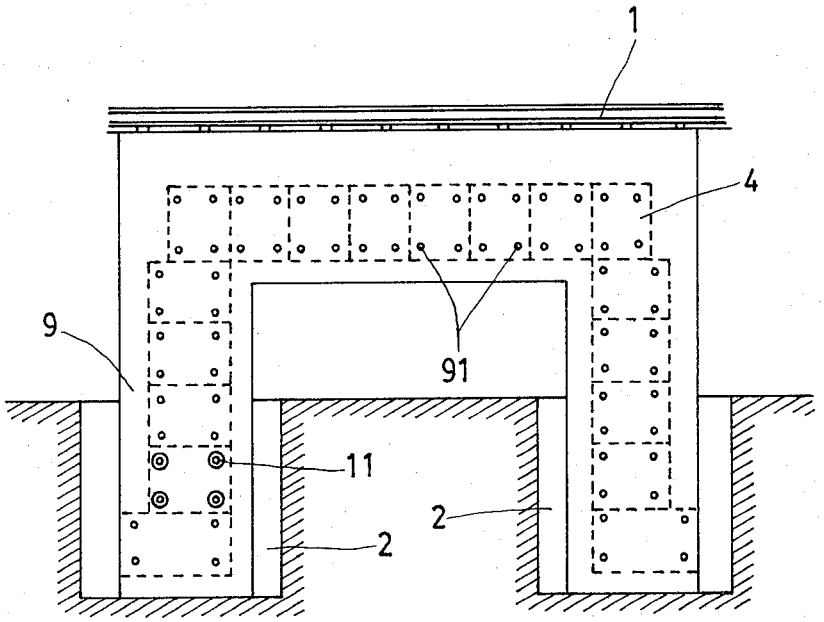
FIG. 2 is a side view of a traction wall taken from FIG. 1.
Figure 3:
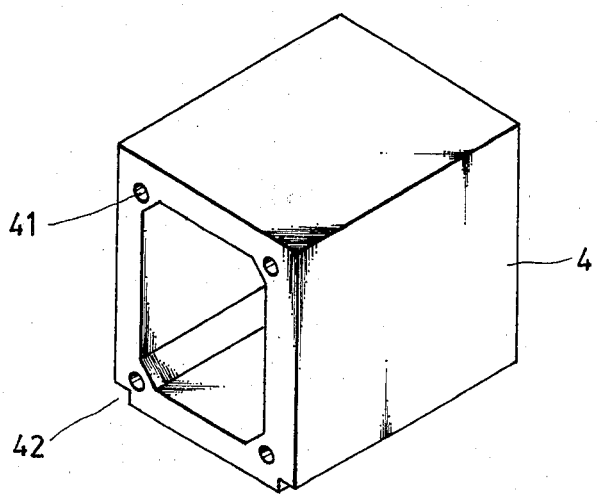
FIG. 3 is a three-dimensional and perspective view of a precast box culvert adopted by this invention.

Referring to FIGS. 1 and 2, according to the present invention, a method of constructing underpass includes the steps of: excavating two traction ditches 2 on one side and two launching ditches, of which the length should be long enough to accommodate more than two precast box culverts 4 therein as well as to provide sufficient working space thereabout, on the other along the road foundation 1; building a reinforced concrete traction wall 9 in the traction ditch 2 along the road foundation 1 according to the construction line thereof with a plurality of traction holes 91 preformed in the traction wall 9 in conjunction with the preformed four holes 41 in the precast box culvert 4 for tracting operations thereafter; using a traversing perforator to make a horizontal hole from the traction hole 91 of the traction wall 9 toward the launching ditch 3 through the preformed hole of the precast box culvert 4; tying a steel cable 5 on the perforator head when the perforator point reached at the launching ditch 3; taking off the end of the steel cable 5 from the perforator head on being pulled back to the traction ditch 2, and having the steel cable end fastened on the traction wall 9 with an anchor fitting 11; securing the other end of the steel cable 5 on a traction jack 12 attached to the tail end of the precast box culvert 4; repeating the same operation as mentioned above for securing other three pieces of the steel cable 5 respectively on the traction wall 9 and the traction jack 12 on the tail end of the first precast box culvert 4, which is a square form (as shown in FIG. 3) with four preformed holes 41 at each corner and a groove joint 42 on both bottom sides; placing a steel knife edge at the advancing end of the first precast box culvert 4; and actuating the oil-pressure pump of each traction jack 12 to track the four steel cables 5 simultaneously in rightward direction toward the traction wall 9 so as to drive the first precast box culvert 4 into the road foundation 1 according to the coustrection line thereof.

Before the traction of the second precast box culvert 4, disconnect the four steel cables 5 together with the traction jacks 12 from the first precast box culvert 4 tracted in position, and remove the earth volume enclosed in the box culvert 4. Similarly, insert the four steel cables 5 into the preformed holes 41 of the second precast box culvert 4, secure the traction jacks 12 on the tail end of the second precast box culvert 4, which is placed against the tail end of the first box culvert 4, start the traction jacks 12 and tract the second box culvert 4 into the road foundation 1 along with the first box culvert 4. Repeat the same procedure performed in the traction of the second box culvert 4, and tract the third, fourth, fifth . . . box culverts into the road foundation 1 until the steel knife edge 6 on the advancing end of the first box culvert 4 abuts against the surface of the traction wall 9.

Figure 5:
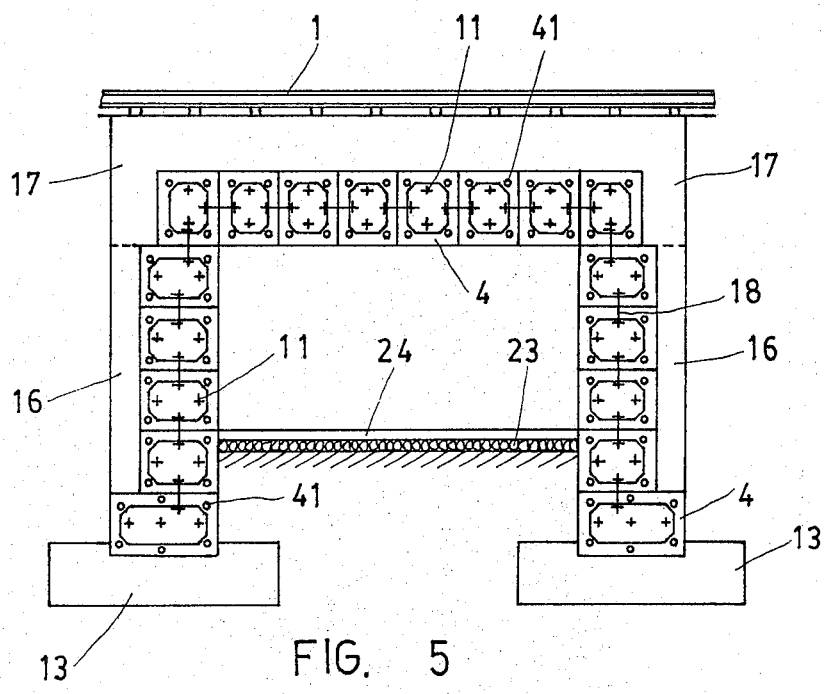
FIG. 5 is a front sectional view of an accomplished underpass constructed in accordance with the method of this inventtion.

Upon completing the first section of the precast box culverts 4, start the second section, third section, fourth section . . . by following the same process as described for the first section operation until an inverse U-shape structure as the cross sectional view shown in FIG. 5 is accomplished therein.

According to the process of this invention, the traction operation of the precast box culverts is conducted by using the traction jacks in tracting the precast box culverts along the preformed holes 41 and 91 in conjunction with the construction line thereof, so that the overlapping as well as the juxtaposing work of the precast box culverts on both sides and the top is accomplished in perfect vertical and horizontal levels as best seen in FIG. 5.

After completion of the traction operation for the underpass structure, take down the traction wall 9, remove all the steel knife edges 6 from the advancing ends of the precast box culverts, and build a pier foundation 13, as shown in FIG. 5, each in the traction ditch 2 and the launching ditch 3. Before starting the construction, a geological examination should, of course, be made in advance for perceiving the bearing strength of the soil thereat and for deciding the configuration of the pier foundation 13. If required, foundation piles shall be used for increasing the bearing strength and preventing the road foundation from sagging in the future.

Figure 6:
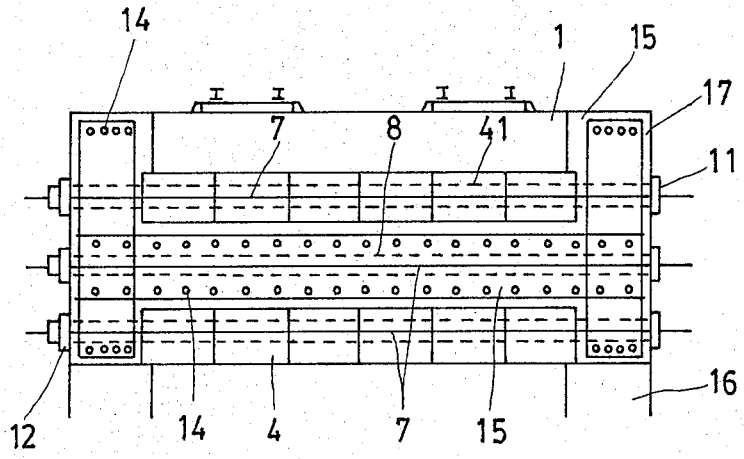
FIG. 6 is a side sectional view taken from FIG. 5.

After placing the concrete 15, referring to FIGS. 5 and 6, for the pier foundation 13, arrange reinforcing steel rods 14 for supports 6 and bridging beams 17 on both sides of the structure, clean the interior compartment of all the precast box culverts, and place a plurality of shell pipes 8 therein. Besides, shell pipes 8 are also placed in the preformed holes 41 as well as on the outer sides of the support 16 and the bridging beam 17 for the later prestress operations.

Figure 4:
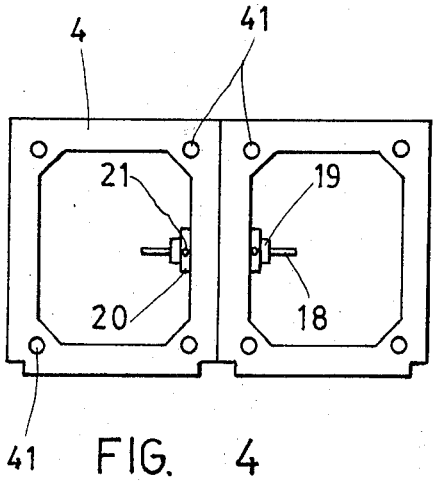
FIG. 4 is a schematic illustration presenting a connection operation between two box culverts according to this invention.

Referring to FIG. 4, all the precast box culverts in the underpass structure are connected in the steps of: perforating a hole in proper distance in the adjoining sides of the precast box culverts; inserting a high tensile threaded bolt 18 in the hole; sleeving a bearing plate 20 having a grouting opening 21 in the side onto the threaded bolt 18; screwing a nut 19 on both sides of the bearing plates 20; tightening the nuts 19 so as to make the box culverts form a single unit; and filling up the grouting opening 21 with mixed cement for preventing the metal parts from getting rusted.

Upon the completion of the aforesaid work, erect moulding boards for the support 16 and the bridging beam 17, and fill up the precast box culverts 4 and the moulding boards with high strength concrete (usually above 300 kg/cm$^2$ of commpresive strength). During the concrete filling operation, high-frequency vibrator is used to make the concrete 15 in compact condition therein.

After a proper curing period, insert a plurality of PC steel reinforcement into the pre-arranged shell pipes; secure one end of the PC steel reinforcements at the outer side of the support 16 and the bridging beam 17 by an anchor fitting 11, and connect the other end to the traction jack 12 (as shown in FIG. 6) for pulling it to a preset strength before fastening the end to the anchor fitting thereof, so that, after the traction jack 12 being removed therefrom, a prestress is effected therein so as to promote the tensile stress and make every one of the precast box culverts be a load bearing beam thereat.

The prestress force of the aforesaid prestressed beam is made up on the basis of the predetermined load and the safety coefficient. If required, each preformed hole 41 of the precast box culverts 4 may be arranged with shell pipes and PC steel reinforcements therein for performing prestress operation so as to increase the strength of the prestressed beam.

On the other hand, if the load requirement of the road surface is relatively small, prestress operation is only done in the preformed holes 41 of the precast box culverts saving the prestress operations in the interior compartment of the precast box culverts as mentioned in the preceding process. Of course, it is also feasible that only cement grouting is done without performing prestress operations, depending on the load requirement thereof.

After the completion of the prestress operation, there comes the final step of excavating the earth volume under the structure of the precast box culverts. As the load bearing structure of the underpass according to this invention has been accomplished, the excavating work will neither affect the traffic on the road surface for speed reducing or detouring nor require steel sheet piling or other operation or facilities for protecting the road foundation, because on both sides of the road foundation the protection is already available given by the support 16 and the bridging beam 17. Therefore, direct excavation for the earth volume under the structure of the precast box culverts can be performed by the excavator. Upon the excavation work is done to a predetermined degree, start placing gravel 23 or filling graded soil and applying concrete 24 for the underpass surface. After the waterproofing work is done by filling up the groove joints 42 among the precast box culverts with epoxy resin, the whole structure of the underpass is accomplished and ready for opening to traffic.

Regarding other work relative to the underpass such as guide pass is not described heretofore because nothing is concerned with this method of construction.

The method of constructing underpass of this invention hereinafter described in detail about the construction process provides the highest efficiency in constructing the underpass or the equivalent structure. It offers not only the highest safety condition but also the lowest cost in construction operations. In addition, this method of constructing underpass requires no any surface finishing work for the structure so that working time is greatly reduced. It shoul be understood that the foregoing is considered as illustrative only of the invention. Therefore, various changes in the construction process or the equivalents may be resorted to, fall withing the cope of this invention as claimed.

I claim:

1. A method of constructing an underpass comprising the steps of;

tracting a plurality of precast box culverts into the road foundation one after another in conjunction with the construction line thereof so that a predetermined inverse U-shape structure is formed therein;

building prestressed beams and support constructions against the section plane of said U-shape structure of the precast box culverts; and directly excavating the earth volume under the U-shape structure of the precast box culverts according the predetermined passage thereof, said tracting being further characterized by including the steps of excavating a traction ditch along one side of the road foundation and a launching ditch on the other in sufficient width as to accommodate at least two precast box culverts and the working people thereof;

building a concrete traction wall in said traction ditch along the road foundation with a plurality of traction holes preformed in said traction wall relativve to the locations of the preformed holes in the precast box culverts;

perforating horizontally from said traction hole of the traction wall through the road foundation toward said launching ditch until the point of the perforating device reached at the tail end of the precast box culvert through the preformed hole aligned thereat;

tying a steel cable at the point of the perforating device from the tail end of the precast box culvert in said launching ditch, pulling back the perforating device to said traction ditch, and fastening the cable end on said traction wall by an anchoring fitting;

securing the other end of said steel cable on a traction jack attached to the preformed hole on the tail end of the precast box culvert;

repeating the same steps of perforating, anchoring, and securing for the remaining preformed holes of the precast box culvert;

placing a steel knife edge on the advancing end of the precast box culvert; and actuating said traction jacks secured on the tail end of the precast box culvert to tract said steel cables simultaneously in a direction toward said traction wall through the road foundation along with the construction line thereof so that the precast box culvert is correctly tracted into the road foundation.

2. A method of constructing an underpass as claimed in claim 1 wherein the method is further characterized be repeating said steps in accordance with the construction line until a predetermined section plane of an inverse U-shape structure is accomplished thereat.

3. A method of constructing an underpass as claimed in claim 2 wherein the method is further characterized by including the step of taking down said traction wall upon completion of the traction operation for said inverse U-shape structure of the precast box culverts.

4. A method of constructing an underpass as claimed in claim 2 wherein the method is characterized by including the further steps of connecting all the adjoining precast box culverts in said U-shape structure by perforating a hole in proper distance on the adjoining sides of the precast box culverts, inserting a high tensile threaded bolt in said hole, sleeving a bearing plate having grouting opening thereof onto said threaded bolt, screwing a nut on both sides of said bearing plate and tightening said nuts, and filling up said grouting opening with mixed cement for preventing the metal parts from getting rusted so that all the precast box culverts in said U-shape structure are consolidated as a single unit.

5. A method of constructing an underpass comprising the steps of:

tracting a plurality of precast box culverts into the road foundation one after another in conjunction with the construction line thereof so that a predetermined inverse U-shape structure is formed therein;

building prestressed beams and support constructions against the section plane of said U-shape structure of the precast box culverts; and directly excavating the earth volume under the U-shape structure of the precast box culverts according the predetermined passage thereof, the step of building the prestressed beam and support construction being characterized by including the further steps of building pier foundations on both sides of the road foundation;

constructing supports and bridging beams against both sides of said U-shape structure; and applying prestress operations through anchoring, tightening and grouting so that each precast box culvert in said U-shape structure is prestressed as well as reinforced by said supports and said bridging beams thereof.

6. A method of constructing an underpass as claimed in claim 5 wherein said prestress operation is further characterized by including the step of inserting said PC steel reinforcements into a plurality of shell pipes arranged in the concerete thereof.

* * * * *